US005819813A

United States Patent [19]

Dewispelaere

[11] Patent Number: 5,819,813

[45] Date of Patent: Oct. 13, 1998

[54] SHED FORMING DEVICE WITH SEPARATE SELECTION AND PULLEY MODULES

[75] Inventor: Andre Dewispelaere, Kortrijk/Marke, Belgium

[73] Assignee: N.V. Michel Van de Wiele, Kortrijk/Marke, Belgium

[21] Appl. No.: 835,418

[22] Filed: Jun. 27, 1997

[51] Int. Cl.[6] ..... D03C 3/20; D03C 3/24

[52] U.S. Cl. ..... 139/455

[58] Field of Search ..... 139/455

[56] References Cited

U.S. PATENT DOCUMENTS

| | | | |
|---|---|---|---|
| 5,309,953 | 5/1994 | Bassi et al. | 139/455 |
| 5,373,871 | 12/1994 | Speich | 139/455 |
| 5,666,999 | 9/1997 | Dewispelaere et al. | 139/455 |

FOREIGN PATENT DOCUMENTS

| | | |
|---|---|---|
| 0214075 | 3/1987 | European Pat. Off. . |
| 0399930 | 5/1990 | European Pat. Off. . |
| 0439440 | 7/1991 | European Pat. Off. . |
| 0544527 | 6/1993 | European Pat. Off. . |
| 0697477 | 2/1996 | European Pat. Off. . |
| 1380967 | 7/1993 | France . |
| 2809248 | 9/1979 | Germany . |
| 8705603 | 1/1987 | Germany . |
| 3090646 | 4/1991 | Japan . |
| 8701142 | 2/1987 | WIPO . |

*Primary Examiner*—Andy Falik

*Attorney, Agent, or Firm*—James Creighton Wray; Meera P. Narasimhan

[57] ABSTRACT

Shed forming device for a textile machine having at least one shed forming mechanism operating with an upward and a downward movement. A movable shed forming element and a pulley element are connected to the shed forming mechanism. A selection device holds the shed forming element at a fixed height. A lifting device moves the shed forming element up and down when it is not held at the fixed height. The selection device is included in a selection module formed as a separate unit which is detachably attached to a pulley module. The pulley module includes the pulley element and the shed forming element and is also detachably attached to a part of the shed forming device.

12 Claims, 2 Drawing Sheets

SHED FORMING DEVICE WITH SEPARATE SELECTION AND PULLEY MODULES

BACKGROUND OF THE INVENTION

This invention relates to a shed forming device for a textile machine, provided with at least one shed forming mechanism comprising,

- a movable shed forming means, provided for working together with a pulley element in order to form a shed between threads of a textile machine,
- a selection device, provided for selecting the shed forming means so that it is held at a fixed height, and
- a lifting device, provided for moving the shed forming means up and down when it is not selected, whereby a detachable module, made as a separate unit, comprises a part of the shed forming mechanism.

Such a shed forming device for a weaving machine has been described in the European patent no. 0214075. With this known device the movable shed forming means, the selection devices and the pulley devices of several shed forming mechanisms are put together in one and the same module, while the parts of one and the same shed forming mechanism are in each case between two separation walls. This module can be taken out of the shed forming device for carrying out repairs or maintenance work, and can be replaced by another (identical) module.

This known device however has the following disadvantages: when one or several selection devices have to be repaired or replaced or have to be taken out for maintenance, prior to removal of the module the harness cords that work together with the pulley devices provided in the module must first be unhooked. After replacing a module these harness cords have to be hooked on again. Unhooking and hooking on the harness cords again is laborious and time-consuming work.

When a module is replaced due to breakage or wear and tear of one or several pulley cords, the intact selection devices provided in the same module are also replaced.

The objective of this invention is to provide a shed forming device for a textile machine, without the above mentioned disadvantages.

SUMMARY OF THE INVENTION

This objective is achieved by providing a shed forming device with the characteristics mentioned in the first paragraph of this description, whereby a selection module comprises the selection device, and a pulley module comprises the pulley element and the shed forming means, while each module is produced as a separate unit and is detachably attached to a part of the shed forming device.

When a selection device has to be taken out for repair, replacement or maintenance, the selection module can be taken out, while the pulley element remains in position on the shed forming device. The harness cords working together with the pulley element consequently do not have to be unhooked. The replacement of a selection device by another selection device can consequently be carried out quickly and without any problem.

It is also particularly advantageous that in case of breakage or wear and tear of one or several of the pulley cords working together with the pulley element the selection device can be removed quickly and easily, and be reinstalled after the replacement of the pulley cords. Furthermore in addition no intact selection devices have to be replaced.

When a pulley cord working together with the pulley element has to be replaced, the pulley module can also be replaced by another pulley module. The replacement of a pulley module is easier to carry out than the replacement of a pulley cord.

In a much preferred embodiment of this shed forming device the selection module is detachably attached to the pulley module. Because of this both modules are detachable together. Furthermore the selection module and the pulley device of one and the same shed forming mechanism can because of this be provided one above the other in a simple manner.

According to a preferred embodiment the shed forming device comprises at least two shed forming mechanisms with respective selection devices that are provided in one and the same selection module.

The selection devices of two shed forming mechanisms working together can for example be provided one behind the other in one and the same selection module, so that the selection module can be produced with a limited width. Furthermore the removal and reinstallment, or replacement, of several selection devices can because of this be carried out faster than in the case where each selection device would be provided in a separate selection module.

According to another preferred embodiment the pulley module comprises every pulley element that works together with the aforementioned at least two shed forming mechanisms (of which the selection devices are provided in the same selection module).

Such an arrangement can be produced particularly compact, while each selection device of one and the same selection module can be provided above a pulley element of one and the same pulley module.

According to a particular embodiment the aforementioned pulley module comprises at least one guiding means for a shed forming means. The pulley module preferably comprises a guiding means for each shed forming means that works together with a pulley element provided in the pulley module.

Moreover each guiding means is preferably also provided for guiding a shed forming means (with its upward and downward movement) above a pulley element, and above the pulley element a selection device is provided for the selection of the shed forming means, during its movement in the guiding means.

The shed forming device can be produced with shed forming mechanisms working together according to claim 6 in order in known manner to make possible two positions of the thereto connected threads of the textile machine.

Preferably the selection devices of the shed forming mechanisms working together are provided in one and the same selection module. The pulley element can also be provided movable in a pulley module produced as a separate unit, while the shed forming cord is attached to a part of the pulley module.

According to a most preferred embodiment the shed forming device comprises several pairs of shed forming mechanisms working together, of which the selection devices are provided in one and the same selection module, while the pulley elements working together with them are provided in one and the same pulley module.

The shed forming device can also be produced with shed forming mechanisms working together according to claim 8 in order in known manner to obtain three positions of the thereto connected threads of the textile machine.

The selection devices of the first and second pair of shed forming mechanisms are preferably provided in one and the same selection module. Moreover the first and the second pulley element can also be provided movable in one and the same or different pulley module(s), produced as a separate unit, while the shed forming cord and the pulley-wheel are attached to a part of the pulley module that comprises the first pulley element.

According to a most preferred embodiment the shed forming device comprises several first and second pairs of shed forming mechanisms working together, of which the selection devices are provided in one and the same selection module, while the pulley elements working together with them are provided in one and the same pulley module.

Each selection device can be produced with a movable holding element that can be brought into a holding position in order to hold a shed forming means at a fixed height, and with an actuator that can bring the holding element into the holding position and into a non-holding position in order to select, respectively not select the shed forming means.

According to an advantageous embodiment the pulley element is movably disposed between two walls of the pulley module. Because of this sideways movements and rotational movements of the pulley elements are precluded.

With a specific embodiment of the shed forming device according to this invention the pulley element is provided in the pulley module, while the pulley module comprises two arms protruding upwards, each of which comprises a guide rail for a respective shed forming means working together with the pulley element, and while a selection module which comprises two selection devices is disposed between the arms, so that each selection device can select a respective shed forming means moving in a guide rail.

The invention will now be further explained in the following detailed description of two preferred embodiments. In this description reference is made to the figures attached hereto, of which FIG. 1 is a side view of an assembled selection module and pulley module (without the front side walls) of a shed forming device for a two-position-open-shed Jacquard machine, FIG. 2 is a side view of an assembled selection module and pulley module (without the front side walls) of a shed forming device for a three-position-open-shed Jacquard machine.

FIG. 3 shows the U-shaped pulley module and the selection module movably disposed in the pulley module.

DETAILED DESCRIPTION OF THE PREFERRED EMBODIMENT

Figure 1:
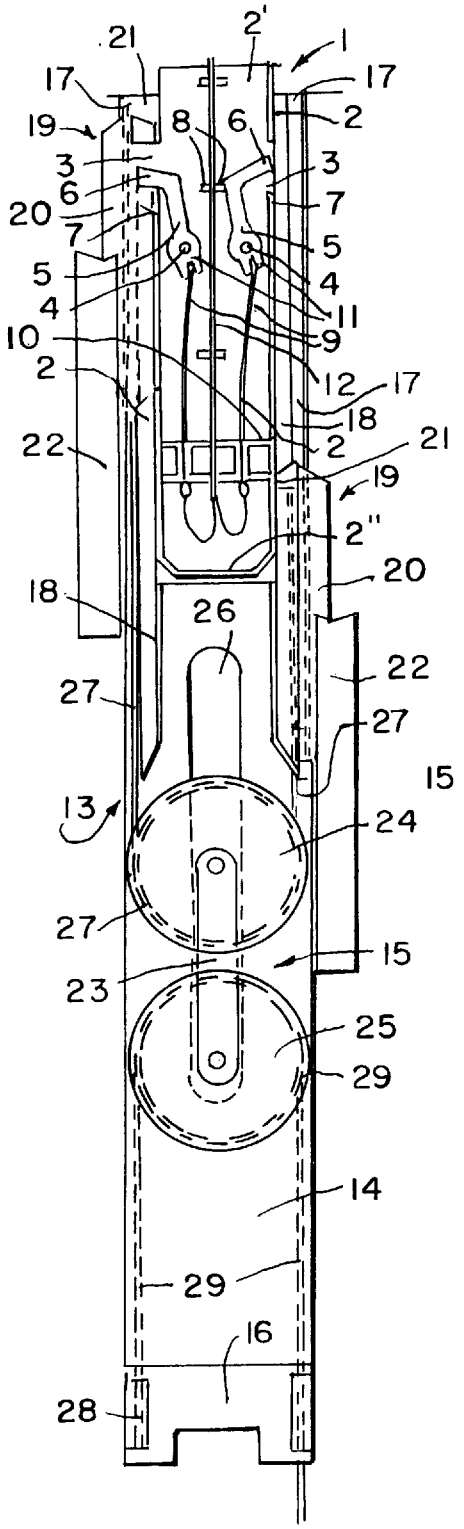

A shed forming device for a two-position-open-shed Jacquard machine (see FIG. 1) and a shed forming device for a three-position-open-shed Jacquard machine (see FIG. 2) according to this invention, comprises a selection module (1) with a front (2) and a rear wall (2), two side walls (2') and a bottom wall (2"), which enclose an inner space. In the figures the side wall (2') directed forwards of the selection module (1) has been removed.

In the inner space enclosed by walls (2, 2', 2") several pairs of selection devices (4,5,6,7,8,9,12) disposed one behind the other are disposed next to each other. The pairs disposed next to each other form a double row of selection devices that extend between the two side walls (2') of the selection module (1). In the figures one pair of selection devices (4,5,6,7,8,9,12) disposed one behind the other is visible.

In the front and the rear wall (2) an opening (3) is provided opposite each selection device (4–9,12). Each selection device (4–9,12) comprises a rotatably (on a spindle (4)) attached holding element (5) with an elongated arm, with an upper bent-over part (6), extending upwards from the spindle (4).

The holding elements (5) of a pair of selection devices (4–9,12) are disposed one behind the other.

The bent-over part (6) of one holding element (5) of each pair is opposite an opening (3) in the front wall (2) and extends towards that opening (3). The bent-over part (6) of one holding element (5) of each pair is opposite an opening (3) in the rear wall (2) and extends towards that opening (3).

Figure 2:
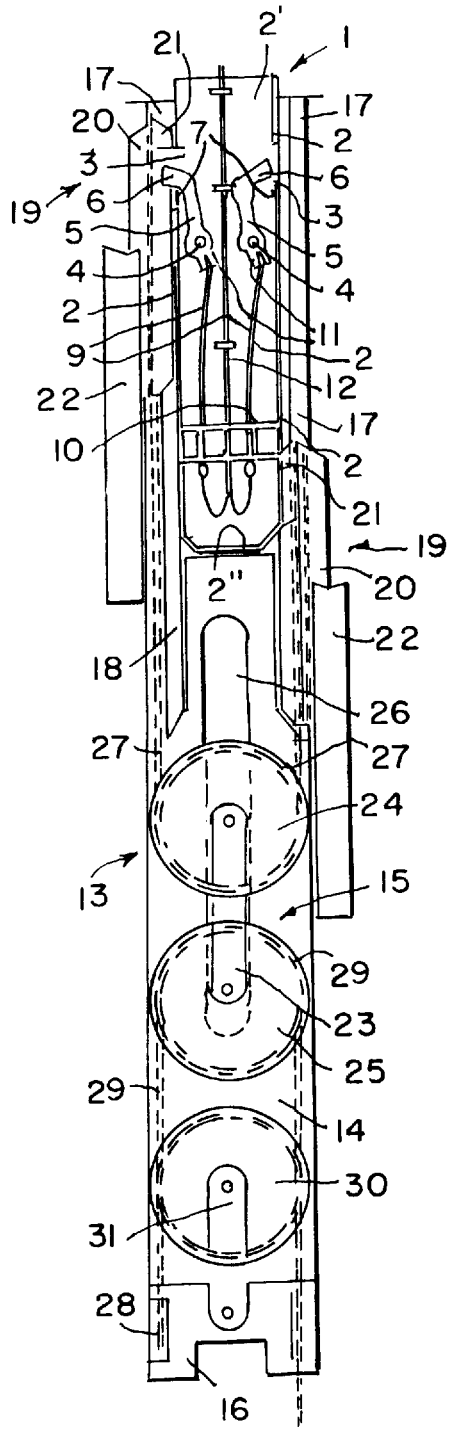

The holding elements (5) can turn until they are in a holding position, whereby the bent-over part (6) rests on the lower edge (7) of a respective opening (3). (The holding element (5) depicted on the left in FIG. 1 is in the holding position). This edge (7) forms a stop for supporting the holding element (1). The holding elements (5) can also turn until they are in a non-holding position, whereby they are stopped by a respective stop element (8), that is disposed centrally in the inner space of the module (1). (The holding element (5) depicted on the right in FIG. 1 is in the non-holding position).

A bimorph piezoelectric bending element (9) is disposed under each holding element (5). The bending elements (9) are securely clamped with a lower extremity in an element (10) provided in the lower part of the module (1), that connects the front (2) and the rear walls (2).

The holding elements (5) also have a short arm (11) that extends along the other side of the spindle (4) in relation to the aforementioned elongated arm. In each short arm (11) a U-shaped groove is provided, whose open side is directed downwards.

The bending elements (9) extend upwards from the element (10), and have their upper extremity in the U-shaped groove in the short arm (11) of a respective holding element (5).

The bending elements (9) can be supplied with electric voltage via respective electric conductors (12) so that they achieve a first bending whereby their upper extremity brings a holding element (5) into the holding position. This is the case for the bending element (9) depicted on the left in FIG. 1. The bending elements (9) can achieve a second bending by reversing the polarity of the electric voltage, whereby their upper extremity brings a holding element (5) into the non-holding position. This is the case for the bending element (9) depicted on the right in FIG. 1.

The shed forming device also comprises a pulley module (13) with several vertical walls (14), provided next to each other with regular spaces between, which are connected to each other, so that they form a separate unit. This unit is detachably attached to a part (not represented in the figures) of a shed forming device.

With the shed forming device for a two-position-open-shed Jacquard machine (FIG. 1) between each pair of walls (14) disposed next to each other a pulley element (15) is disposed vertically movable. In the figures the front wall (14) of the pulley module (13) has been removed.

The number of pulley elements (15) disposed between walls (14) is identical to the number of pairs of selection devices (4–9, 12) provided next to each other in the selection module (1). Each pulley element (15) has a body (23), to which two pulley-wheels (24), (25) one above the other are rotatably attached. The pulley elements (15) are so disposed that their pulley-wheels (24), (25) are in a vertical operating plane that runs parallel to the walls (14).

Figure 3:
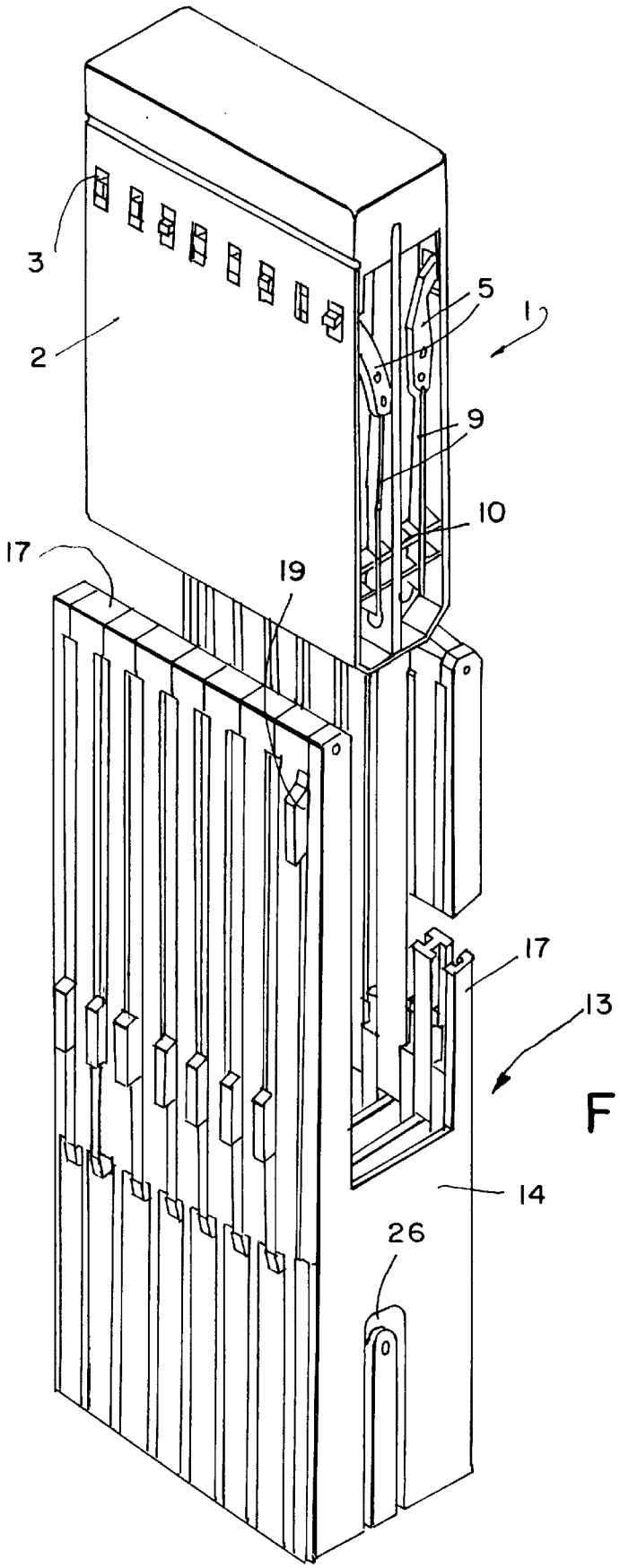

For each pulley element (15) a wall (14) is provided, which comprises two extending arms (17) at the top in the extension of its vertical edges. The upper edge of such a wall (14) and the arms (17) moreover form a U-shaped upper part of the wall (14). There are therefore as many arms (17) as there are selection devices (4–9, 12) provided in the selection module (1). The selection module (1) is disposed inside the U-shaped parts of the various walls (14), as seen in FIG. 3.

The pulley module (13) furthermore also comprises a bottom piece (16) extending under the walls (14), which is part of the walls (14). Each arm (17) comprises a vertical guide rail (18) for a respective hook (19), and extends to above a respective opening (3) in the front or rear wall (2) of the selection module (1).

In each guide rail (18) a vertically movable hook (19) is provided, whereby each hook (19) is selectable by a respective selection device (4–9, 12) in the selection module (1).

Two hooks (19) that are guided by the respective arms (17) of one and the same wall (14) can be selected by respective selection devices (4–9,12) disposed one behind the other (which have been indicated as higher than a pair of selection devices (4–9, 12)). Two such hooks (19) are called coacting hooks (19) in the following.

Each hook (19) has a protruding wing (20) on the back and a protrusion (21) on top at the front. The coacting hooks are movably disposed in the guide rails (18), with their fronts directed towards each other. On both sides of the joined together modules (1), (13) two blades (22) are provided which can be brought into an upward and downward movement in opposition by a drive device (not represented in the figures).

Moreover a horizontal upper edge of each blade (22) can grip under a lower edge of the protruding wing (20) of a respective hook (19). The coacting hooks (19) can consequently be moved up and down in opposition by the blades (22). In the upper dead point of their movement the protrusions (21) of the hooks (19) are brought above the holding elements (5).

When the holding elements (5) are in the holding position, their bent-over parts (6) are in the movement path of the protrusion (21) of a respective hook (19).

Each time when a blade (22) is at the end of its upward movement, for each hook (19) working together with that blade (22) it can be determined whether the hook (19) has to be held at a fixed height or has to be engaged by the blade (22), during the following movement cycle of the blade (22).

A hook (19) is after all each time brought with its protrusion (21) above the holding element (5). When the holding element (5) is subsequently brought into the holding position, the protrusion (21) will, with the following downward movement of the hook (19), arrive on the top of the bent-over part (6) of the holding element (5). The hook (19) will consequently be supported by the holding element (5) and remain above at a fixed height during the following movement cycle of the blade (22).

At the end of the following upward movement of the blade (22), the blade (22) will take the hook (19) supported by the holding element (5) along upwards to above the holding element (5).

When the holding element (5) remains in the holding position, the hook will again remain above on the holding element (5) during the following movement cycle (as described above).

When the holding element (5) on the other hand is brought into the non-holding position, the hook (19) will be engaged by the blade (22) for the following movement cycle of the blade (22), and therefore first move downwards and subsequently upwards.

Each pulley element (15) is disposed between two walls (14) of the pulley module (13), while the body (23) is slidable in a vertically extending groove (26) in one of those walls (14).

Each pair of hooks (19) disposed one behind the other (which work together with each other) are connected to each other by an upper pulley cord (27), which runs round the upper pulley wheel (24) of the pulley element (15) disposed under these hooks, so that the pulley cord (27) attached to the hooks (19) carries the pulley element (15). During the upward and downward movement (in opposition) of these hooks (19) the pulley element (15) remains at a first height. When one of the hooks (19) is held in an upper position, the pulley element (15) will as a result of the hoisting of the other hook (19) be brought up to a second height.

Under each pulley element (15) on the bottom piece (16) of the pulley module (13) a means of attachment (28) is provided, to which one extremity of the lower pulley cord (29) is attached. This lower pulley cord (29) runs over the lower pulley wheel (25) of the pulley element (15) thereabove and subsequently extends downwards, where the other extremity is provided in order to form a shed between threads of a textile machine.

Because of the fact that the pulley element (15) can be brought to two different heights, this is also the case for the hanging-down extremity of the lower pulley cord (29).

By providing a Jacquard machine with a shed forming device as described above, a two-position-open-shed Jacquard machine is obtained. Such a Jacquard machine can for example be used on a weaving machine, for forming a shed between warp threads. The warp threads can be raised by harness cords, which are hung onto a hanging-down extremity of a lower pulley cord (29) of the shed forming device.

With a shed forming device for a three-position-open-shed Jacquard machine (FIG. 2) the pulley module (13) is distinguished from the above described pulley module (13) because of the fact that between two walls (14) in each case two pulley elements (15) are disposed vertically movable in the manner described above, because of the fact that on the bottom piece (16) between each pair of walls (14) a reversing wheel (30) is attached, and because of the fact that each lower pulley cord (29) has another route.

Each pulley element (15) works together with two coacting hooks (19)—by means of respective upper pulley cords (27)—in the manner described above.

Each reversing wheel (30) is revolvingly attached to an arm (31) that is rotatably attached to the bottom piece (16) of the pulley module (13). The arm (31) can rotate in a plane (the plane of the drawing) extending parallel to the walls (14) of the module (13).

The pulley elements (15) between each pair of walls (14) are movably disposed in respective vertical operating planes. Each pulley wheel (30) is preferably diagonally disposed between these operating planes.

Between each pair of walls (14) a lower pulley cord (29) is provided, one extremity of which is attached under a first pulley element (15) to the bottom piece (16) of the pulley module (13), runs round the lower pulley-wheel (25) of this first pulley element (15), subsequently runs round the reversing wheel (30) disposed between the same walls (14), subsequently runs round the lower pulley-wheel (25) of the second pulley element (15) provided between the same walls (14), and finally extends downwards, where the other extremity is foreseen for forming a shed between threads of a textile machine.

It is known how the hanging-down extremity of the lower pulley cord (29) can be brought to three different heights with the coacting hooks (19), which work together with the first and the second pulley element (15).

For obtaining a four-position-open-shed Jacquard machine the aforesaid extremity of the lower pulley cord (29) can be attached to a movable grid, which together with one of the blades (22) can be brought to an upward and downward movement.

I claim:

1. Shed forming device for a textile machine having at least one shed forming mechanism comprising a movable shed forming element, and a pulley element forming together with the shed forming element a shed between threads of the textile machine, a selection device for selecting the shed forming element and holding the shed forming element at a fixed height, a lifting device connected to the shed forming element for moving the shed forming element up and down when not selected, a detachable module separably included in the shed forming mechanism, a selection module holding the selection device, a pulley module holding the pulley element and the shed forming element, wherein each of the selection module and the pulley module is a separate unit adapted to be detachably mounted on a part of the shed forming device.

2. The shed forming device of claim 1, wherein the selection module is adapted to be detachably attached to the pulley module.

3. The shed forming device of claim 1, wherein the shed forming device comprises at least two shed forming mechanisms, with respective selection devices provided in the selection module.

4. The shed forming device of claim 3, wherein the pulley module comprises plural pulley elements working together with the at least two shed forming mechanisms.

5. The shed forming device of claim 1, wherein the pulley module comprises at least one guide for the shed forming element.

6. The shed forming device of claim 1, further comprising a pair of coacting shed forming mechanisms with respective shed forming elements movable up and down in opposition by the lifting device, a pulley cord connecting the respective shed forming elements to each other, the pulley cord running around a first pulley-wheel of the pulley element, a shed forming cord attached to a part of the shed forming device running around a second pulley-wheel of the pulley element thereby forming a shed between threads of the textile machine.

7. The shed forming device of claim 6, wherein the pulley element is movable in the pulley module, and wherein the shed forming cord is attached to a part of the pulley module.

8. The shed forming device of claim 1, wherein the shed forming device comprises a first pair of shed forming mechanisms with respective first shed forming element movable up and down in opposition by the lifting device, a second pair of shed forming mechanisms with respective second shed forming elements movable up and down in opposition by the lifting device, a first pulley cord connecting the first shed forming elements to each other, wherein the first pulley cord runs around a first pulley-wheel of a first pulley element, a second pulley cord connecting the second shed forming elements each other, the second pulley cord running around a first pulley-wheel of a second pulley element, a shed forming cord attached to a part of the shed forming device and successively running around a second pulley-wheel of the first pulley element, a reversing wheel attached to a part of the shed forming device, and a second pulley-wheel of the second pulley element thereby forming a shed between threads of the textile machine.

9. The shed forming device of claim 8, wherein the first and the second pulley elements are movable in one or in different pulley modules and wherein the shed forming cord and the reversing wheel are attached to a part of the pulley module having the first pulley element.

10. The shed forming device of claim 1, wherein the selection device comprises a movable holding element movable into a holding position for holding the shed forming element at a fixed height, and an actuator for bringing the holding element into a holding position and into a nonholding position for respectively selecting or not selecting the shed forming element.

11. The shed forming device of claim 1, wherein the pulley element is adapted to be movably disposed between two walls of the pulley module.

12. The shed forming device of claim 1, wherein the pulley element is disposed movably in the pulley module, the pulley module comprising two arms protruding upwardly, each arm having a guide rail for a respective shed forming element working together with the pulley element, and wherein the selection module comprises two selection devices disposed between the two arms such that each selection device selects a respective shed forming element moving in the guide rail.

* * * * *